US006464807B1

(12) United States Patent
Torizuka et al.

(10) Patent No.: US 6,464,807 B1
(45) Date of Patent: Oct. 15, 2002

(54) PRODUCTION METHOD OF ULTRA FINE GRAIN STEEL

(75) Inventors: Shiro Torizuka; Osamu Umezawa; Kaneaki Tsuzaki; Kotobu Nagai, all of Ibaraki (JP)

(73) Assignee: Japan as represented by Director General of National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/512,060

(22) Filed: Feb. 24, 2000

(30) Foreign Application Priority Data

Feb. 26, 1999 (JP) ..... 11-051799
Aug. 31, 1999 (JP) ..... 11-246698

(51) Int. Cl.[7] ..... C21D 8/00
(52) U.S. Cl. ..... 148/653; 148/654
(58) Field of Search ..... 148/653, 654

(56) References Cited

U.S. PATENT DOCUMENTS 5,483,811 A * 1/1996 Miller ..... 72/197
6,221,178 B1 * 4/2001 Torizuka et al. ..... 148/320

FOREIGN PATENT DOCUMENTS

JP 58123823 * 7/1983

OTHER PUBLICATIONS

A. Najafi–Zadeh, J.J. Jonas, and S. Yue, Grain refinement by dynamic recrystallization during the simulated warm–rolling of interstitial free steels, Metallurgical Transactions A, vol. 23A Sep. 1992, 2607–2617.*

Torizuka, S.; Umezawa, O.; Tsuzaki, K.; Nagai, K., Refinement of ferrite–pearlite structures through transformation from heavily deformed austenite in a lowearbon Si–Mn Steel, Mater. Sci. Forum, (1998), 284–286, 225–230 (abstract only).*

Xu, Zhou; Taku, Sakai, Effect of hot deformation on the ferrite grain size of Ti–bearing interstitial–free steel, Jixie Gongcheng Cailiao (1997), 21(2), 7–9, 18 (abstract only).*

* cited by examiner

*Primary Examiner*—Sikyin Ip
(74) *Attorney, Agent, or Firm*—Weneroth, Lind & Ponack, L.L.P.

(57) ABSTRACT

A method of producing a ultra fine grain steel made of ferrite having a mean grain size of not larger that 3 $\mu$m as the base phase, after ingoting raw materials, by austenitizing the ingot by heating it to a temperature of at least an Ac 3 point, then, applying compression working of a reduction ratio of at least 50% at a temperature of from an Ae 3 point or lower to an Ar 3 point −150° C., or at a temperature of at least 550° C., and thereafter, cooling, wherein the strain rate as compression working is in the range of from 0.001 to 10/second.

2 Claims, 4 Drawing Sheets

PRODUCTION METHOD OF ULTRA FINE GRAIN STEEL

FIELD OF THE INVENTION

The present invention relates to a production method of a ultra fine grain steel. More specifically, the invention relates to a method of producing a ultra fine grain steel useful as a welding steel having a high strength.

BACKGROUND OF THE INVENTION

Hitherto, a controlled rolling-accelerated cooling technique is an effective method for obtaining fine ferrite in a low-alloy steel. That is, by controlling a cumulative percentage of reduction in an austenite non-recrystallization region and the cooling rate thereafter, a fine grain has been obtained. However, the ferrite grain size obtained is at most 10 μm in an Si-Mn steel and at most 5 μm in an Nb steel as the limits. Furthermore, as described in Japanese Patent Publication Nos. 39228/1987 and 7247/1987, it is reported that by adding a reduction that the sum total area reduction ratio of 75% or higher in the temperature range of Ar1 to Ar3+100° C. including a 2-phase region and thereafter cooling at a cooling rate of at least 20 K/second, ferrite grains having grain sizes of from about 3 to 4 μm are obtained. However, as is mentioned in, for example, Japanese Patent Publication No. 65564/1993, for obtaining ferrite grains having grain sizes of smaller than 3 μm, very large reduction amount and cooling rate (at least 40 K/second) are required. Quenching of the cooling rate of at least 20 K/second is a means capable of being realized only in the case of a thin sheet thickness and cannot be realized for the production method of steels for general welding structure, which is widely and practically used. Also, with regard to strong working itself, in roll rolling, it is generally difficult to carry out a large reduction exceeding 50% at an austenite low-temperature range because the extent of the deformation resistance and the restriction on one pen rolling. Also, for the cumulative reduction in a non-recrystallization region, at least 70% of reduction is necessary in general, which is also difficult because of the temperature lowering of steel sheet.

It is known that a ferrite grain structure of a control-rolled steel generally has an strong texture, and the ferrite grains obtained as the result of a strong reduction becomes to have a small angle grain boundary. That is, by simple strong working, an strong texture is formed and ferrite grains made of a large angle grain boundary cannot be obtained. Accordingly, even when strong working higher than those shown in Japanese Patent Publication Nos. 39228/1987 and 7247/1987 is carried out, it is difficult to obtain a fine ferrite grain structure made of a large angle grain boundary.

Under such circumstances, the present inventors previously developed methods of obtaining a ultra fine grain steel made of ferrite having a mean grain size of not larger than 3 μm as the base phase, after austenitizing raw materials by heating to a temperature of at least an Ac 3 point, applying compression working of the reduction ratio of at least 50% at a temperature of at least the Ar 3 point and cooling (Japanese Patent Application Nos. 256682/1997, 256802/1997, and 52545/1998). By this new production methods, it becomes possible to provide a ultra fine grain steel made of, as the base phase, ferrite having a mean grain size of not larger than 3 μm and surrounded by a large angle grain boundary of an Disorientation of at least 15°.

However, a further improvement has been practically desired on these new methods. This is because it is desirable to obtain a finer grain and also, from the industrial viewpoint, the deformation resistance at hot working is desirably as low as possible. In particular, when working of at least 50% is carried out in an austenite low-temperature range by one pass, the deformation resistance is large and it is desirable to lower the resistance as low as possible. That is, in regard to obtain ferrite having a mean grain size of not larger than 3 μm, and preferably not larger than 2 μm as the main phase by working at an austenite low-temperature range and control cooling, it can be said that a new method capable of producing a ultra fine grain steel made of ferrite having a mean grain size of not larger than 3 μm, preferably not larger than 2 μm as the main phase under a lower deformation resistance, by a less reduction amount, and by a particularly slow cooling rate has been required.

SUMMARY OF THE INVENTION

The present invention has been made under the circumstances as described above and to provide a new method of producing a ultra fine grain steel made of ferrite having a mean grain size of not larger than 3 μm, preferably not larger than 2 μm as the base phase under a lower deformation resistance, by a less reduction amount, and by a particularly slow cooling rate.

That is, a 1st aspect of the invention provides a method of producing a ultra fine grain steel made of ferrite having a mean grain size of not larger than 3 μm, after ingoting raw materials, by austenitizing the ingot by heating it to a temperature of at least an Ac 3 point, then, applying compression working of at least a reduction ratio of at least 50% at a temperature of from an Ae 3 point or lower to an Ar 3 point −150° C., or to a temperature of at least 550° C., and thereafter, cooling, wherein the strain rate as compression working is in the range of from 0.001 to 10/second.

A 2nd aspect of the invention provides the ultra fine grain steel made of ferrite having a mean grain size of not larger than 2 μm as the base phase produced by the method described above.

A 3rd aspect of the invention provides the production method of the aspect 1 wherein the strain rate is in the range of from 0.01 to 1/second.

Also, a 4th aspect of the invention provides the production method of the aspect 1 wherein the cooling rate after working is not higher than 10 K/second.

DETAILED DESCRIPTION OF THE INVENTION

Then, the present invention is described in detail.

As described above, as the result of various investigations, the present inventor has found that the control of the temperature and the strain rate at compression working is very effective for fining the grain of a steel formed and lowering the deformation resistance, and more specifically that when a ferrite-pearlite stracture is formed by strong working of exceeding 50% at a temperature of not higher than Ae 3 point and control-cooling, fine ferrite grains having a mean grain size of not larger than 3 μm, and further not larger than 2 μm are obtained and has accomplished the invention based on the knowledge.

Thus, the production method of the invention is explained in more detail. In the production method of the invention;

<A> austenitizing an ingot of the raw materials by heating the ingot to a temperature of at least an Ac 3 point, <B> compression working of a reduction ratio of at least 50% at a temperature of from an Ae 3 point or lower to an Ar 3 point −150° C. or a temperature of at least 550° C., and <C> cooling thereafter are fundamental process requirements.

In this case, the Ae 3 point is the highest temperature at which ferrite (excluding delta-ferrite) can exist on the phase diagram at the austenite-ferrite equilibrium transformation point. Also, the Ar 3 point shows the initiation temperature of the austenite-ferrite transformation at no working. Also, in the method of this invention, at the compression working <B>, the strain rate is defined in the range of from 0.001 to 10/second.

Figure 1:
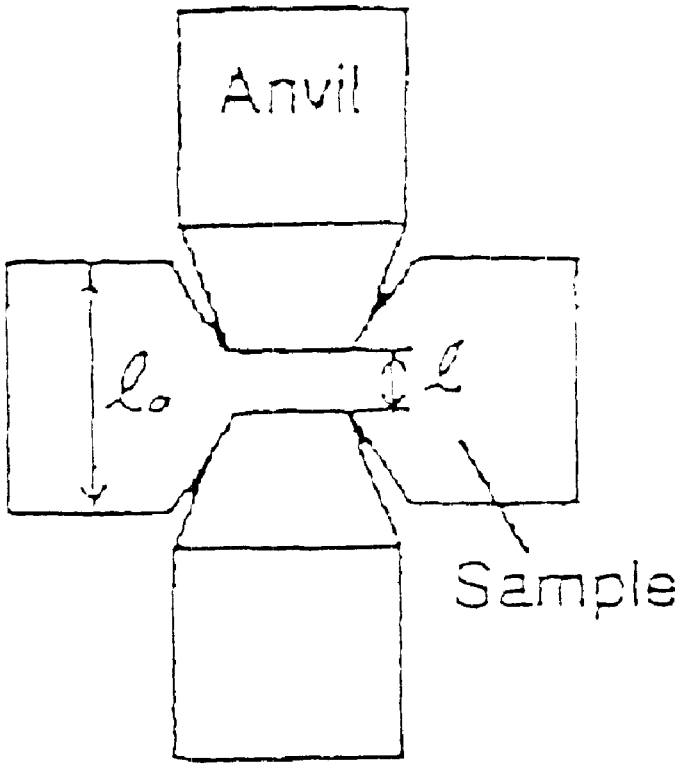
FIG. 1 is a cross-sectional view of the essential portion showing anvil compression working and strain.

For example as illustrated in FIG. 1 which shows plane compression working by an anvil moving up and down, if the thickness of an element (sample) by compression working is changed from $1_0$ to 1 within the time of t seconds, the strain (ϵ) is shown by $$\epsilon = ln(lo/l),$$

and hence the strain rate is ϵ/t, that is, shown by $$\epsilon/t = ln(lo/l)/t$$

In the invention, as described above, the strain rate is from 0.001 to 10/second, and properly from 0.01 to 1/second.

When the strain rate is higher than 10/second, the deformation resistance is large and the fining effect of ferrite is less. Also, the strain rate is lower than 0.001/second, a very long time is required for working. Thus, each case described above is industrially disadvantageous.

In the invention, for compression working, the method of anvil working shown in FIG. 1 is more properly employed.

For example, the case of anvil compression working described above is a method capable of carrying out strong working exceeding 1 pass 90% as the reduction ratio, and in the case, by controlling driving speed of the anvil disposed above and under an element (sample) , it becomes possible to control the strain rate at compression working.

Also, in the production method of the invention, in the cooling step <C>, it is also effective to lower the cooling rate to 10 K/second or lower.

By the production method of the invention, a ultra fine grain steel made of, as the base phase, ferrite having a mean grain size of not larger than 3 μm, and further not larger than 2.5 μm, and surrounded by a large angle grain boundary of an misorientation of at least 15° can be produced. The ratio of the large angle grain boundary in the ferrite-ferrite grain boundary is at least 80%. Thus, a weldable steel having a high strength can be economically obtained. There is no particular restriction on the chemical composition of the steel but preferably, the steel can be constituted by Fe containing not more than 0.3% by weight C (carbon), and Si, Mn, P, S, N and unavoidable impurities. It is more preferably that Fe contains not more than 2% (by weight) Si, not more than 3% Mn, not more than 0.1% P, not more than 0.02% S, and not more than 0.005% N.

On the other hand, Fe constituting the steel may further contain Cr, Ni, Mo, and Cu each not more than 3% by weight, and further may contain from 0.003 to 0.1% by weight Ti, from 0.003 to 0.05% by weight Nb, and from 0.005 to 0.2% by weight V. However, in this invention, the ultra fine grain is obtained without using Ni, Cr, Mo, Cu, etc., which are expensive elements, and the high-strength steel can be produced at a low cost.

The raw materials for making the ingot, the addition ratio of each element is properly determined according to the chemical composition described above.

Then, the present invention is described in more detail by the following examples.

EXAMPLES 1 TO 5 AND COMPARATIVE EXAMPLE 1

After completely austenitizing steel (1) having the composition shown in Table 1 below by heating it to 900° C., the steel was cooled to the working temperature shown in Table 2 below and then immediately subjected to plane strain compression working illustrated in FIG. 1 at a reduction ratio of 75%. The Ae 3 point was 817° C., and the Ar 3 point measured by a thermal dilatation was 670° C. The strain rates and the cooling rates after compression working employed were shown in Table 2. With regard to the structure obtained, the mean grain size of ferrite, the kind of the 2nd phase, the volume percentage thereof, the ratio of the large angle grain boundary (misorientation≧15°) , and the mean deformation resistance at working are shown in Table 2. The Disorientation of each ferrite grain was measured by an electron back scattering diffraction (EBSD) method. The mean grain size was measured by a linear intercept method. The 2nd phases were mainly pearlite and carbide.

TABLE 1

[Composition of steel (1)]

| C | Si | Mn | P | S | N | Al |
|---|---|---|---|---|---|---|
| 0.15 | 0.3 | 1.5 | 0.02 | 0.005 | 0.002 | 0.04 |

TABLE 2

| | Working temperature (° C.) | Strain rate (l/s) | Cooling rate (K/s) | Mean deformation resistance (kg/cm$^2$) | Ferrite grain size (μm) | Ratio of large angle grain boundary (%) |
|---|---|---|---|---|---|---|
| E1 | 750 | 1 | 10 | 43 | 1.9 | 95 |
| E2 | 750 | 0.1 | 10 | 32 | 1.9 | 94 |
| E3 | 750 | 0.01 | 10 | 21 | 1.8 | 95 |
| E4 | 750 | 0.001 | 10 | 10 | 2.6 | 95 |
| E5 | 750 | 0.1 | 2.5 | 32 | 2.0 | 92 |
| CE1 | 750 | 20 | 10 | 50 | 2.5 | 95 |

E: Example; CE: Comparative Example

As is clear from the comparison of Examples 1 to 5 with Comparative Example 1 shown above, when the strain rate is from 0.01 to 1/second, the finest ferrite grain is obtained and in regard to the deformation resistance, when the strain rate is lowered, remarkable lowering is confirmed.

Also, from Examples 2 and 5, it can be seen that when the cooling rate is fast, fining of the ferrite grains proceeds.

EXAMPLES 6 TO 18

By following the same procedure as Examples 1 to 5, compression working was carried out and cooled under the conditions shown in Table 3 below. The results obtained are shown in Table 3 below.

From the results shown in Table 3, it can be seen that at the strain rate of from 0.001 to 10/second, fine ferrite grains are obtained. Also, it can be seen that lowering of the working temperature is effective for fining of the steel structure.

TABLE 3

| | Working temperature (° C.) | Strain rate (l/s) | Cooling rate (K/s) | Mean deformation resistance (kg/cm$^2$) | Ferrite grain size ($\mu$m) | Ratio of large angle grain boundary (%) |
|---|---|---|---|---|---|---|
| E6 | 700 | 10 | 10 | 57 | 1.5 | 95 |
| E7 | 700 | 1 | 10 | 49 | 1.0 | 95 |
| E7 | 700 | 0.1 | 10 | 39 | 1.6 | 95 |
| E8 | 700 | 0.01 | 10 | 29 | 1.7 | 95 |
| E9 | 700 | 0.001 | 10 | 17 | 2.0 | 95 |
| E9 | 650 | 10 | 10 | 65 | 0.8 | 93 |
| E10 | 650 | 1 | 10 | 58 | 0.6 | 93 |
| E11 | 650 | 0.1 | 10 | 49 | 0.8 | 93 |
| E12 | 650 | 0.01 | 10 | 40 | 1.4 | 93 |
| E13 | 650 | 0.001 | 10 | 30 | 1.9 | 93 |
| E14 | 600 | 10 | 10 | 86 | 0.8 | 95 |
| E15 | 600 | 1 | 10 | 74 | 0.5 | 81 |
| E16 | 600 | 0.1 | 10 | 64 | 0.6 | 90 |
| E17 | 600 | 0.01 | 10 | 53 | 0.9 | 91 |
| E18 | 600 | 0.001 | 10 | 43 | 1.1 | 90 |

E: Example

EXAMPLE 9 AND COMPARATIVE EXAMPLES 2 TO 6

In the examples described above, when compression working was applied to the material wherein the austenite grain size was 17 $\mu$m, at a working temperature of 750° C., the reduction rate of 75&, the strain rate of 0.1/second, and the cooling rate of 10 K/second, the cross-sectional SEM image of the steel obtained was observed. The photograph is shown in FIG. 2.

Figure 3:
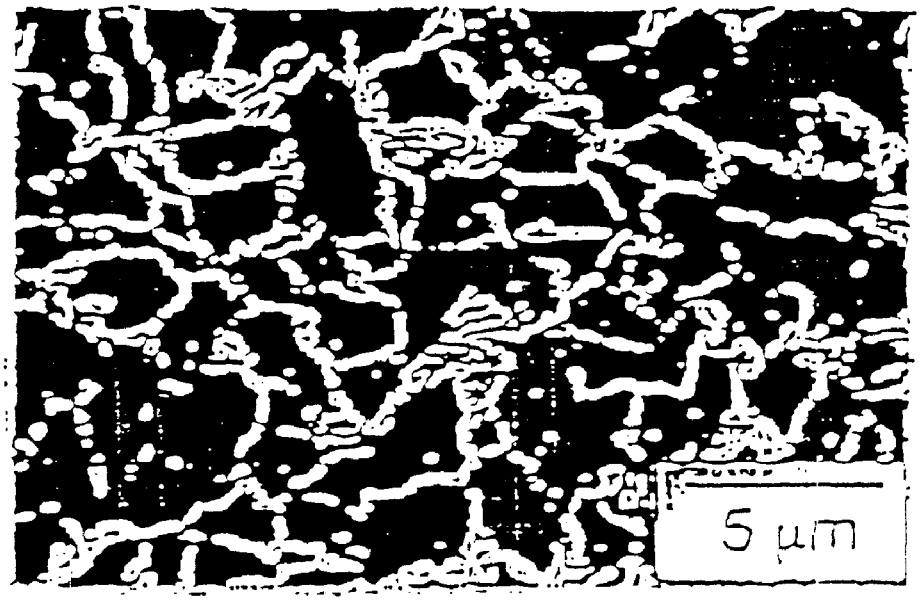
FIG. 3 is an SEM photograph showing the cross section of a steel of a comparative example.
Figure 4:
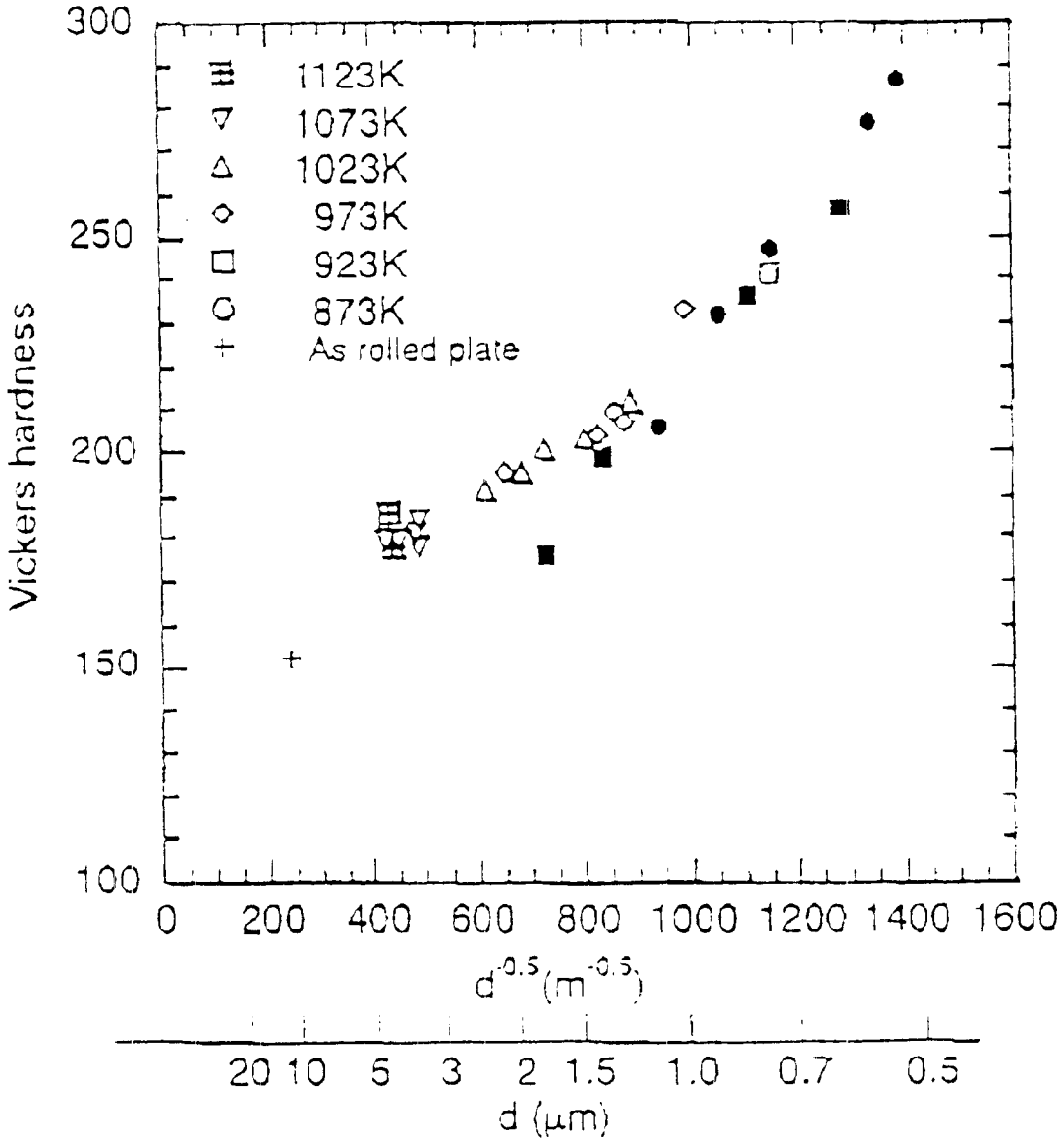
FIG. 4 is a view showing the relation of the ferrite grain size and a Vickers hardness.

Also, FIG. 3 is the cross-sectional SEM photograph of a steel obtained when the strain rate was 20/second.

Figure 2:
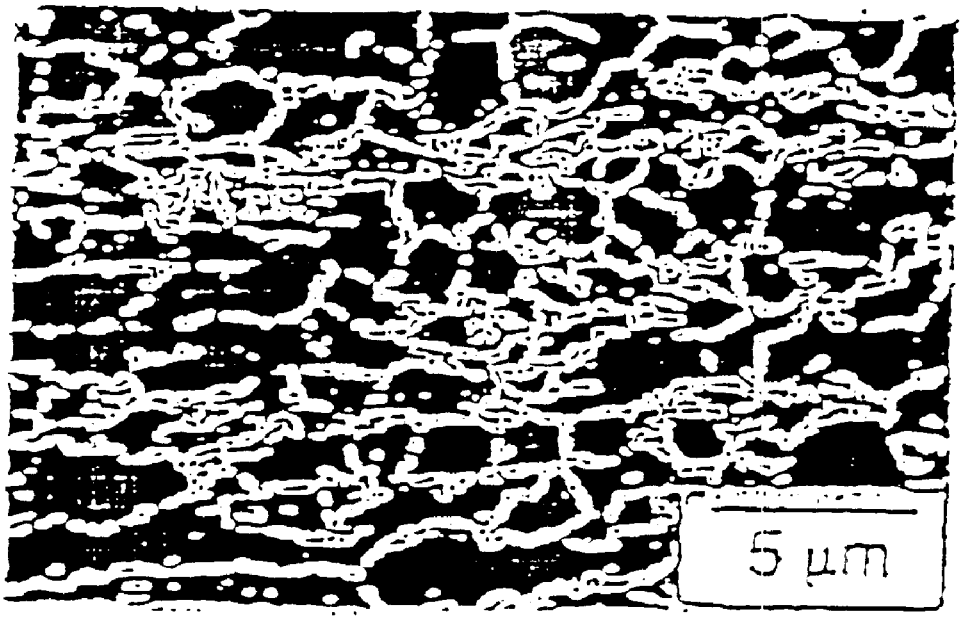
FIG. 2 is an SEM photograph showing the cross section of an embodiment of the steel of the invention.

From FIG. 2 and FIG. 3, it can be seen that by slowing the strain rate, fining the ferrite grains is proceeded.

Also, a Hall Petch relationship showing the relation of the ferrite grain size d and the Vickers hardness (Hv) is recognized. The temperatures in the figure show the working temperatures.

The Vickers hardness of the fine structure steel made of ferrite grains having a mean grain size of 2.3 $\mu$m is 203 and according to the relationship of TS=3.435 Hv, it corresponds to the tensile strength of about 700 MPa. For reference, when a fine tension test piece (3.5 mm parallel portion length×2 mm width×0.5 mm thickness) was prepared and a tension test was carried out at a cross-head speed of 0.13 mm/minute, a tensile strength of 675 MPa was obtained.

In Table 4, comparative examples of the case that the working temperature was 850° C. exceeding the Ae 3 point (817° C.) are shown. It can be seen that the ferrite grain size exceed 5 $\mu$m in each case.

TABLE 4

| | Working temperature (° C.) | Strain rate (l/s) | Cooling rate (K/s) | Mean deformation resistance (kg/cm$^2$) | Ferrite grain size ($\mu$m) | Ratio of large angle grain boundary (%) |
|---|---|---|---|---|---|---|
| CE2 | 850 | 10 | 10 | 32 | 5.3 | — |
| CE3 | 850 | 1 | 10 | 27 | 5.2 | — |
| CE4 | 850 | 0.1 | 10 | 22 | 5.4 | — |
| CE5 | 850 | 0.01 | 10 | 15 | 6 | — |
| CE6 | 850 | 0.001 | 10 | 8 | 6 | — |

CE: Comparative Example

As described above in detail, according to the invention, a new method capable of producing a ultra fine grain steel made of ferrite having a mean grain size of not larger than 3 $\mu$m as the base phase under a lower deformation resistance and at a lower reduction ratio and a particularly slow cooling rate is provided.

What is claimed is:

1. A method of producing a ultra fine grain steel with a base phase made of ferrite having a mean grain size of not larger than 3 $\mu$m, which comprises, after ingoting raw materials, austenitizing the ingot by heating it to a temperature of at least Ac 3 point, then, applying anvil compression working of at least a reduction ratio of at least 50% at a temperature of from an Ae 3 point or lower to an Ar 3 point −150° C., or to a temperature of at least 550° C., and thereafter, cooling, wherein the strain rate at anvil compression working is in the range of from 0.001 to 10/second.

2. The method of producing a ultra fine grain steel according to claim 1 wherein the cooling rate after compression working is not higher than 10 K/second.

* * * * *